US009176401B2

(12) United States Patent
Tsurumi et al.

(10) Patent No.: US 9,176,401 B2
(45) Date of Patent: Nov. 3, 2015

(54) ELECTROSTATIC IMAGE DEVELOPING CARRIER, PROCESS OF MAKING THE SAME, ELECTROSTATIC IMAGE DEVELOPER, PROCESS CARTRIDGE, IMAGE FORMING METHOD, AND IMAGE FORMING APPARATUS

(71) Applicant: FUJI XEROX CO., LTD., Tokyo (JP)

(72) Inventors: Yosuke Tsurumi, Kanagawa (JP); Rieko Kataoka, Singapore (SG)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/091,200

(22) Filed: Nov. 26, 2013

(65) Prior Publication Data

US 2014/0141371 A1 May 22, 2014

Related U.S. Application Data

(62) Division of application No. 12/556,985, filed on Sep. 10, 2009, now abandoned.

(30) Foreign Application Priority Data

Mar. 11, 2009 (JP) ..... 2009-057395

(51) Int. Cl.
*G03G 9/10* (2006.01)
*G03G 9/08* (2006.01)
(Continued)

(52) U.S. Cl.
CPC ..... *G03G 9/0802* (2013.01); *G03G 9/107* (2013.01); *G03G 9/1075* (2013.01); *G03G 9/113* (2013.01); *G03G 9/1139* (2013.01)

(58) Field of Classification Search
CPC ..... G03G 9/107; G03G 9/1075; G03G 9/10; G03G 9/1133
USPC ..... 430/111.31, 111.34
See application file for complete search history.

(56) References Cited

U.S. PATENT DOCUMENTS 5,441,839 A 8/1995 Ishikawa et al.
5,466,552 A 11/1995 Sato et al.
(Continued)

FOREIGN PATENT DOCUMENTS

JP A-62-182758 8/1987
JP A-6-301245 10/1994
(Continued)

OTHER PUBLICATIONS

Jun. 11, 2013 Office Action issued in Japanese Application No. 2009-057395 (with English translation).
(Continued)

*Primary Examiner* — Hoa V Le
(74) *Attorney, Agent, or Firm* — Oliff PLC

(57) ABSTRACT

An electrostatic image developing carrier includes a ferrite particle that contains from about 1.0% by weight to about 14.0% by weight of elemental magnesium, wherein an average distribution ratio D of the elemental magnesium in the ferrite particle is from about 1.1 to about 2.0, wherein the average distribution ratio D is defined as an average value of D' of at least 50 ferrite particles, wherein D' is defined as W1/W2, wherein W1 is a weight ratio of elemental magnesium content Mg to elemental iron content Fe, Me/Fe, in a whole cross-section of the ferrite particle, and W2 is a weight ratio of elemental magnesium content Mg to elemental iron content Fe, Me/Fe, in a square, the two opposite vertices of which are located at two points on a diameter of a circle circumscribing the cross-section, each being half a radius distant from the center of the circumscribing circle.

4 Claims, 1 Drawing Sheet

(51) Int. Cl.
*G03G 9/107* (2006.01)
*G03G 9/113* (2006.01)

(56) References Cited

U.S. PATENT DOCUMENTS

| | | | | |
|---|---|---|---|---|
| 5,565,296 | A | | 10/1996 | Kmiecik-Lawrynowicz et al. |
| 5,876,893 | A | * | 3/1999 | Ochiai et al. ..... 430/111.33 |
| 5,929,136 | A | | 7/1999 | Creatura et al. |
| 5,932,388 | A | | 8/1999 | Umeno et al. |
| 2003/0091923 | A1 | | 5/2003 | Kobayashi et al. |
| 2006/0199093 | A1 | | 9/2006 | Iinuma et al. |
| 2007/0087282 | A1 | | 4/2007 | Iinuma et al. |
| 2008/0070150 | A1 | | 3/2008 | Kobayashi et al. |
| 2008/0171281 | A1 | * | 7/2008 | Kobayashi et al. ..... 430/111.31 |
| 2009/0176170 | A1 | * | 7/2009 | Sugiura et al. ..... 430/111.31 |
| 2009/0197190 | A1 | | 8/2009 | Nakamura et al. |
| 2009/0197194 | A1 | | 8/2009 | Aga et al. |
| 2010/0233608 | A1 | | 9/2010 | Tsurumi et al. |

FOREIGN PATENT DOCUMENTS

| | | | |
|---|---|---|---|
| JP | A-07-333910 | | 12/1995 |
| JP | A-08-194338 | | 7/1996 |
| JP | A-09-166888 | | 6/1997 |
| JP | A-10-142842 | | 5/1998 |
| JP | A-2001-154416 | | 6/2001 |
| JP | A-2008-96977 | | 4/2008 |
| SU | 350056 | * | 9/1971 |

OTHER PUBLICATIONS

U.S. Appl. No. 12/556,985, filed Sep. 10, 2009 in the name of Tsurumi et al.

* cited by examiner

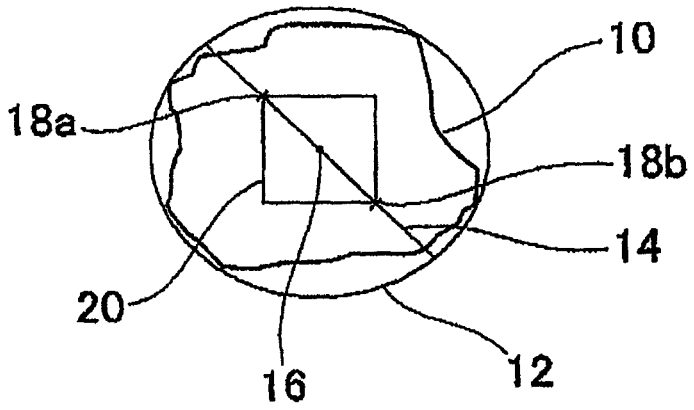
10
18a
18b
14
20
16
12

ELECTROSTATIC IMAGE DEVELOPING CARRIER, PROCESS OF MAKING THE SAME, ELECTROSTATIC IMAGE DEVELOPER, PROCESS CARTRIDGE, IMAGE FORMING METHOD, AND IMAGE FORMING APPARATUS

CROSS-REFERENCE TO RELATED APPLICATIONS

This application is a divisional of U.S. application Ser. No. 12/556,985, filed Sep. 10, 2009, which in turn is based on and claims priority under 35 USC 119 from Japanese Patent Application No. 2009-057395 filed on Mar. 11, 2009.

BACKGROUND

1. Technical Field

This invention relates to an electrostatic image developing carrier, a process of making the carrier, an electrostatic image developer, a process cartridge, an image forming method, and an image forming apparatus.

2. Related Art

Methods for visualizing a latent image of image information, such as electrophotography, are widely used in various fields. An electrophotographic method, for example, includes the steps of charging, exposing, developing (developing an electrostatic latent image on the surface of an image holding member or a photoreceptor with a developer containing a toner), transferring, and fixing. The developer is divided into two types: two-component developer composed of a toner and a carrier and one-component developer containing a toner alone, such as a magnetic toner. In the two-component developer the functions as a developer are separately performed by a toner and a carrier such that the carrier bears the functions of agitation, transportation, and charging. Therefore, the two-component developer is currently widespread because of its superiority in, for example, controllability.

SUMMARY

According to an aspect of the invention, there is provided an electrostatic image developing carrier including a ferrite particle that contains from about 1.0% by weight to about 14.0% by weight of elemental magnesium, wherein an average distribution ratio D of the elemental magnesium in the ferrite particle is from about 1.1 to about 2.0, wherein the average distribution ratio D is defined as an average value of D' of at least 50 ferrite particles, wherein D' is defined as W1/W2, wherein W1 is a weight ratio of elemental magnesium content Mg to elemental iron content Fe, Me/Fe, in a whole cross-section of the ferrite particle, and W2 is a weight ratio of elemental magnesium content Mg to elemental iron content Fe, Me/Fe, in a square, the two opposite vertices of which are located at two points on a diameter of a circle circumscribing the cross-section, each being half a radius distant from the center of the circumscribing circle.

BRIEF DESCRIPTION OF THE DRAWINGS

Exemplary embodiment (s) of the present invention will be described in detail based on the following figures, wherein:

FIGURE schematically illustrates measurement of the elemental magnesium distribution ratio D' in a ferrite particle, wherein

10 denotes a cross-section of a ferrite particle, 12 denotes a circle circumscribing the cross-section 10, 14 denotes a diameter of the circumscribing circle 12, 16 denotes a center of the circumscribing circle 12, 18*a* and 18*b* denote points on a diameter 14 of the circumscribing circle 12, each one-half a radius distant from the center 16 of the circumscribing circle 12, and 20 denotes a square having two opposing vertices located at points 18*a* and 18*b*.

DETAILED DESCRIPTION

The present invention will be described in detail below.

In the invention, the description of "(from) A to B" shows a scope including "A" as well as "B", not a scope between "A" and "B". For example, when "(from) A to B" shows a range of "numerical value", it means "A or more and B or less".

(Electrostatic Image Developing Carrier)

A carrier of an aspect of the invention includes a ferrite particle containing about 1.0% by weight to about 14.0% by weight of elemental magnesium. The average distribution ratio D of the elemental magnesium in the ferrite particle is from about 1.1 to about 2.0. The average distribution ratio D of is defined as an average value of D' of at least 50 particles, wherein D' is defined as W1/W2, wherein W1 is a weight ratio of elemental magnesium content Mg to elemental iron content Fe, Me/Fe, in a whole cross-section of a ferrite particle, and W2 is a weight ratio of elemental magnesium content Mg to elemental iron content Fe, Me/Fe, in a square, the two opposite vertices of which are located at two points on a diameter of a circle circumscribing the cross-section, each being half a radius distant from the center of the circumscribing circle.

A ferrite containing iron and magnesium exhibits higher ability to negatively charge a toner and higher electrical resistance as the magnesium content increases. However, as the content of magnesium, which has no magnetic moment, increases, the ferrite has lower saturation magnetization. A reduction in magnesium content results in increased saturation magnetization, but the composition approaches that of magnetite, resulting in reduction of resistance, and the effect of magnesium in charging properties becomes insubstantial. Insufficient charging properties of carrier particles readily cause fog, low magnetization, and image defects such as color streaks due to low-resistant carrier scattering. For these reasons, it has been difficult to use magnesium ferrite as a carrier. In using magnesium-containing ferrite particles, it has been necessary to add other element, such as Mn, Co, Ni or Cu, so as to achieve a balance between magnetization and resistance.

As a result of extensive investigations, the present inventors have found that the above problem is settled by controlling the distribution of magnesium in magnesium ferrite particles. It is assumed that magnetization, resistance, and charging properties are well balanced when magnesium is distributed more in the surface portion than in the central portion of ferrite particles probably for the following reasons.

Electrification of a toner and a carrier generates by the contact therebetween so that the composition of the surface of the carrier particle is greatly influential on the charging behavior. Carrier particles having a high magnesium content in their surface portion and a low magnesium content in their central portion exhibit improved charging properties owing to the high magnesium content in their surface portion and yet has a controlled overall magnesium content to keep a satisfactory saturation magnetization owing to the low magnesium content in their central portion.

Presence of magnesium not only brings about improved negatively charging properties but also offers an advantage that change in charging performance with environmental change is reduced. In general, manganese ferrite, copper-zinc ferrite, and the like have low charging properties. Even when in using an element with high ionization tendency, such as lithium ion, they are considered to have high affinity to water, resulting in reduced charging performance in a high temperature and high humidity condition. With these ferrites, the effects as produced by magnesium ferrite would be hardly obtained.

In the cases where a magnesium compound, such as magnesium oxide, is incorporated into a resin coating layer, it is difficult to obtain sufficient charging properties. This is because, whilst a ferrite is a large ion crystal, a magnesium compound has a form of fine independent particles and also because charge mobility within the particles is low.

Another problem with a conventional magnesium ferrite is that it breaks easily. Magnesium ferrite has a high rate of crystallization to become particles liable to fracture. However, when magnesium is distributed more in the surface portion, the crystallization in the surface portion is retarded compared with the inner portion so that the continuous crystal plane becomes small. It is considered that the particles are stronger and less liable to fracture as a result. Furthermore, because the crystals are not continuous, there are increased crystal boundary faces so that the resistance is not reduced.

It is thus assumed that ferrite particles having an increased magnesium content in the surface portion and a reduced magnesium content in the central portion, i.e., having an average distribution ratio D of the elemental magnesium being about 1.1 to about 2.0 are able to achieve a balance of electrical resistance, saturation magnetization, and strength on their high levels. This seems to account for the constancy of image density and good appearance of an image formed by using the carrier and retention of the image density constancy even after the carrier is used in printing in a low temperature and how humidity condition followed by being left to stand in a high temperature and high humidity condition.

<Ferrite Particle>

The ferrite particle that can be used in the invention contains about 1.0% by weight to about 14.0% by weight of elemental magnesium and an average distribution ratio D of the elemental magnesium in the ferrite particle is from about 1.1 to about 2.0.

The average distribution ratio D of the elemental magnesium in the ferrite particles is calculated using, for example, X-ray fluorescence. X-Ray fluorescence analysis is preferably carried out by preparing a calibration curve using a few samples with known magnesium contents, analyzing a sample, and calculating the magnesium content of the sample from the calibration curve. More specifically, carrier particles are embedded in an epoxy resin, and the resulting block is sliced with a diamond knife until a cross-section of carrier particles appears sufficiently. The elemental iron content Fe and elemental magnesium content Mg of the entire cross-section are determined using an energy dispersive X-ray analyzer (EMAX, from Horiba, Ltd.) to obtain an Mg/Fe weight ratio W1. As illustrated in FIGURE, a circumscribing circle 12 is drawn around the cross-section 10 of a ferrite particle, and a square 20 is drawn in the central portion of the circumscribing circle 12, the opposite vertices 18*a* and 18*b* of the square 20 being on a diameter 14 and one-half the radius distant from the center 16 of the circumscribing circle 12. An Mg/Fe weight ratio W2 in the square is determined. A ratio of W1 to W2, W1/W2, is calculated to give an elemental magnesium distribution ratio D' of the particle. The same measurements are made on at least 50 ferrite particles to obtain an average distribution ratio D.

The diameter 14 of the circumscribing circle 12 to the cross-section 10 of the ferrite particle may be a diameter at any position.

The cross-section 10 of a ferrite particle to be analyzed is preferably cut through at or near the center of the particle. The ferrite particles to be analyzed may have a resin coat hereinafter described.

The average distribution ratio D of the elemental magnesium in the ferrite particle for use in the invention is about 1.1 to about 2.0, preferably about 1.1 to about 1.8, more preferably about 1.3 to about 1.7.

Ferrite is generally represented by formula: $(MO)_x(Fe_2O_3)_y$ wherein M is mainly Mg and optionally contains at least one of Li, Ca, Mn, Sr, Sn, Cu, Zn, Ba, Fe, Ti, Ni, Al, Co, and Mo; and x and y indicate molar ratios satisfying x+y=100.

The ferrite for use in the invention preferably contains at least one element selected from the group consisting of Li, Ca, Mn, Sr, Ti, Al, and Si, more preferably at least one element selected from the group consisting of Ti, Si, Ca, Mn, and Sr, in addition to Fe, Mg, and O.

The magnesium content in the ferrite for use in the invention is 1.0% to 14.0% by weight, preferably 1.0% to 12.0% by weight, more preferably 2.0% to 7.0% by weight.

The ferrite particles for use in the invention have a higher magnesium content in the surface portion than in the central portion. It is preferred that the magnesium content increases continuously from the central to surface portions.

The volume average particle size of the carrier of the invention is preferably about 10 μm to about 500 μm, more preferably about 20 μm to about 120 μm, even more preferably about 30 μm to about 100 μm, especially preferably about 30 μm to about 80 μm.

The volume average particle size of the ferrite particles for use in the invention is preferably 10 to 500 μm, more preferably 20 to 120 μm, even more preferably 30 to 100 μm, especially preferably 30 to 80 μm.

The carrier of the invention may be the above described ferrite particle or a resin-coated carrier having the above described ferrite particle coated with a resin.

Examples of useful resins forming a resin coat include copolymers of fluorine-containing vinyl monomers, such as vinylidene fluoride, tetrafluoroethylene, hexafluoropropylene, monochlorotrifluoroethylene, and trifluoroethylene; and homo- or copolymers of styrene and its derivatives, such as chlorostyrene and methylstyrene, α-methylene aliphatic monocarboxylic acid and esters thereof, such as (meth) acrylic acid, methyl (meth)acrylate, ethyl (meth)acrylate, propyl (meth)acrylate, butyl (meth)acrylate, lauryl (meth) acrylate, 2-ethylhexyl (meth)acrylate, and phenyl (meth) acrylate, nitrogen-containing acrylic compounds, such as dimethylaminoethyl methacrylate, nitriles, such as (meth) acrylonitrile, vinylpyridines, such as 2-vinylpyridine and 4-vinylpyridine, vinyl ethers, vinyl ketones, olefins, such as ethylene, monochloroethylene, propylene, and butadiene, and silicones, such as methylsilicone and methylphenylsilicone. Polyesters containing bisphenol, glycol, etc. are also useful. These resins may be used either individually or as a mixture of two or more thereof. Preferred of the resins recited are styrene-(meth)acrylic acid-methyl (meth)acrylate copolymers. As used herein, the term "(meth)acryl" and its cognate terms are intended to include both acryl and methacryl.

The amount of the coating resin is preferably about 0.2% by weight to about 5.0% by weight, more preferably about 1.0% by weight to about 3.5% by weight, based on the total weight of the carrier.

If desired, the resin coat layer may contain an electrically conductive powder to control resistance or for other purposes. Examples of conductive materials of the conductive powder include metals, such as gold, silver, and copper, carbon black, Ketjen black, acetylene black, and semiconductive oxides, such as titanium oxide, and zinc oxide. Particles of titanium oxide, zinc oxide, barium sulfate, aluminum borate, and potassium titanate coated with tin oxide, carbon black or metal are also useful. These conductive powders may be used either individually or in combination of two or more thereof.

The conductive powder is preferably other than metals or metal compounds. Carbon black powder is particularly preferred in view of production stability, cost, and conductivity. Carbon black to be used preferably has, though non-limitedly, a dibutyl phthalate (DBP) absorption value of 50 to 250 ml/100 g in terms of good stability in production.

The conductive powder preferably has a volume average particle size of about 0.5 μm or smaller, more preferably about 0.05 μm to about 0.5 μm, even more preferably about 0.05 μm to about 0.35 μm. Particles having a volume average particle size of about 0.5 μM or smaller are less likely to detach from the resin coat layer and provide stable charging properties.

The volume average particle size of the conductive powder is measured with a laser diffraction particle size analyzer (LA-700, from Horiba, Ltd.). A sample to be analyzed is prepared by dispersing 2 g of a conductive powder in 50 ml of a 5% aqueous solution of a surfactant (preferably a sodium alkylbenzenesulfonate) using an ultrasonic disperser at 1000 Hz for 2 minutes. The volume average particle size for every channel is accumulated from the side of the small particle size to draw a cumulative particle size distribution curve. The particle diameter at which a cumulative percentage of 50% is attained is taken as a volume average particle size.

The conductive powder preferably has a volume resistivity of $10^1$ to $10^{11}$ Ω·cm, more preferably $10^3$ to $10^9$ Ω·cm. The volume resistivity of the conductive powder is measured in the same manner as for the core.

The conductive powder content is preferably 1% to 50% by volume, more preferably 3% to 20% b volume, based on the whole resin coat layer. With the content less than 50%, the resistance of the carrier is not reduced so that image defects due to the carrier adhering to a developed image are eliminated. With the content more than 1%, the carrier has moderate electrical resistance so that the carrier sufficiently serves as a developing electrode to exhibit excellent reproducibility of a solid image, which is particularly effective in reducing the edge effect in reproducing a solid black image.

The resin coat layer may further contain resin particles, such as thermoplastic resin particles and thermosetting resin particles. Addition of thermosetting resin particles is preferred to increase the hardness with relative ease. Addition of nitrogen-containing resin particles is recommended in terms of enhancing negatively charging properties. These resin particles may be used individually or as combined.

The volume average particle size of the resin particles is preferably about 0.1 μm to about 2.0 μm, more preferably about 0.2 μm to about 1.0 μm. Resin particles of about 0.1 μm or greater have good dispersibility in the resin coat layer. Resin particles of about 2.0 μm or smaller produce their essential effect without falling off the resin coat layer. The volume average particle size of the resin particles is determined in the same manner as for the conductive powder.

The content of the resin particles is preferably about 1% by weight to about 50% by weight, more preferably about 1% by weight to about 30% by weight, even more preferably about 1% by weight to about 20% by weight, based on the whole resin coat layer. When added in an amount of about 1% or more, the resin particles produce the expected effects. With the resin particles content being not more than about 50%, they provide stable charging performance without falling off the resin coat layer.

The resin coat layer may further contain known additives, such as a wax and a charge controlling agent. The resin coat layer may have a single layer structure or bi- or multilayer structure.

(Process of Making Electrostatic Image Developing Carrier)

The carrier of the invention is preferably produced by a process including the steps of (1) providing a carrier material containing an iron compound and a magnesium compound, (2) provisionally calcining the carrier material at a temperature of about 800° C. to about 1000° C., (3) grinding the calcined product, (4) granulating the ground product, (5) mainly calcining the granules at a temperature higher than about 1000° C. and not higher than about 1400° C., and (6) additionally calcining the mainly calcined carrier material at a temperature lower than the temperature of the main calcination.

<Providing Step>

The process of producing the carrier according to the invention preferably includes the step of provisionally calcining a carrier material containing an iron compound and a magnesium compound at a temperature of about 800° to about 1000° C.

Any known material can be used as a carrier material, including oxides, hydroxides, and carbonates. A preferred carrier material includes at least $Fe_2O_3$ and MgO or Mg $(OH)_2$. A more preferred carrier material includes $Fe_2O_3$, MgO or Mg $(OH)_2$, and one of $TiO_2$, $SrCO_3$, and $CaCO_3$.

The amounts of the iron compound, magnesium compound, and compounds containing other necessary elements are decided as appropriate to the desired ferrite composition.

The calcining temperature at the provisional calcining step is about 800° C. to about 1000° C., preferably about 850° C. to about 1000° C., more preferably about 900° C. to about 1000° C.

The calcining time at the provisional calcining step is preferably 0.5 to 48 hours, more preferably 1 to 12 hours, while varying depending on the composition of the carrier material, the calcining temperature, the degree of drying, and the like.

The provisional, main, and additional calcining steps are carried out using known devices, such as an electric furnace or a rotary kiln.

It is preferred that the carrier material be ground and blended prior to the provisional calcination. It is more preferred that the ground and mixed carrier material be granulated and dried using, for example, a spray dryer.

The provisional calcination may be conducted once or several times, preferably twice.

The process more preferably includes a first provisional calcination step in which the carrier material is calcined at about 800° C. to about 1000° C., a first grinding step in which the calcined carrier material is ground after the first provisional calcination step, a first granulation step in which the ground carrier material is granulated after the first grinding step, and a second provisional calcination step in which the granulated carrier material is calcined at about 800° C. to about 1000° C. after the first granulation step. While the calcining temperature in the first and second provisionally calcination steps ranges from about 800° C. to about 1000° C., it is preferred that the calcining temperature in the second provisional calcination step be higher than that in the first provisional calcination step. The first grinding step, which may be inserted between the first and second provisional calcination steps, is preferably effected until the calcined carrier material has a volume average particle size of 0.5 to 5 μm.

<Main Calcining Step>

The process preferably includes the step of mainly calcining the provisionally calcined carrier material, after the provisional calcination step, at a temperature higher than about 1000° C. and not higher than about 1400° C. The calcining temperature at the main calcining step is higher than about 1000° C. and not higher than about 1400° C., preferably higher than about 1150° C. and not higher than about 1400° C., more preferably about 1200° to about 1350° C. The calcining time at the main calcining step is preferably 1 to 24 hours, more preferably 2 to 12 hours, while varying according to the composition of the carrier material, the calcining temperature, the degree of drying, and the like.

<Additional Calcining Step>

The process preferably includes the step of additionally calcining the thus mainly calcined carrier material, after the main calcining step, at a temperature lower than the calcining temperature at the main calcining step. The calcining temperature in the additional calcining step is lower than the calcining temperature at the main calcining step, and is preferably about 800° C. or higher and lower than about 1400° C., more preferably about 900° C. or higher and lower than about 1250° C., even more preferably about 1100° C. or higher and lower than about 1200° C. The calcining time in the additional calcining step is preferably 0.5 to 24 hours, more preferably 1 to 6 hours, while varying according to the composition of the carrier material, the calcining temperature, and the like.

It is preferred that the main calcining step be continuously followed by the additional calcining step.

<Grinding Step, and Granulation Step>

The process preferably includes the steps of grinding the provisionally calcined carrier material after the provisional calcining step, granulating the ground carrier material after the grinding step, and mainly calcining the ground carrier material at a temperature higher than about 1000° C. and not higher than about 1400° C. after the granulating step.

The grinding step may be carried out using a known apparatus, such as a wet ball mill. The granulation step may be carried out using a known apparatus, such as a spray dryer. The grinding step is preferably effected until the calcined carrier material has a volume average particle size of 1 to 10 μm, more preferably 2 to 8 μm.

The granulation step is preferably followed by the step of drying the granulated carrier material.

<Coating Step>

The process preferably includes the step of coating the ferrite particle obtained from the additional calcining step with a resin.

The step of coating the ferrite particle with a resin is carried out by, for example, applying to ferrite particles a resin coat layer-forming composition prepared by adding a coating resin such as described above and, if necessary, additives to an appropriate solvent. The solvent is not limited and may be chosen as appropriate for the coating resin, application properties, and the like.

Application methods include a dipping method in which the ferrite particles are dipped in the resin coat layer-forming composition, a spray method in which the resin coat layer-forming composition is sprayed to the ferrite particles, a fluidized bed method in which the resin coat layer-forming composition is sprayed to ferrite particles fluidized in an air stream, and a kneader coater method in which the ferrite particles and the resin coat layer-forming composition are mixed in a kneader coater to remove the solvent.

Any solvent that is capable of dissolving only the coating resin may be used. Examples of known useful solvents include aromatic hydrocarbons, such as toluene and xylene, ketones, such as acetone and methyl ethyl ketone, ethers, such as tetrahydrofuran and dioxane, and mixtures thereof.

(Electrostatic Image Developer)

The electrostatic image developer (also called "developer") according to an aspect of the invention contains the carrier of the invention and a toner. A toner to carrier mixing ratio is preferably 1:99 to 20:80, more preferably 3:97 to 12:88, by weight. The carrier and a toner are mixed by any known method and means, such as a twin-cylinder mixer.

<Electrostatic Image Developing Toner>

The toner that can be used in the invention is not particularly limited, and any known toner may be used. For example, color toners made of a binder resin and a coloring agent and infrared absorbing toners made of a binder resin and an infrared absorbing material may be used.

The toner for use in the invention preferably includes toner particles and an external additive externally added to the toner particles for ease of flowability and chargeability control.

<Toner Particles>

The toner particles preferably contain a binder resin, a coloring agent, and, if necessary, a release agent, silica, and a charge controlling agent.

Examples of the binder resin include homo- and copolymers of styrenes, such as styrene and chlorostyrene; monoolefins, such as ethylene, propylene, butylene, and isoprene; vinyl esters, such as vinyl acetate, vinyl propionate, vinyl benzoate, and vinyl butyrate; α-methylene aliphatic monocarboxylic acid esters, such as methyl (meth)acrylate, ethyl (meth)acrylate, butyl (meth)acrylate, dodecyl (meth) acrylate, octyl acrylate, and phenyl acrylate; vinyl ethers, such as vinyl methyl ether, vinyl ethyl ether, and vinyl butyl ether; vinyl ketones, such as vinyl methyl ketone, vinyl hexyl ketone, and vinyl isopropenyl ketone. Representative binder resins include polystyrene, styrene-alkyl (meth)acrylate copolymers, styrene-acrylonitrile copolymers, styrene-butadiene copolymers, styrene-maleic anhydride copolymers, polyethylene, and polypropylene. Further included in useful binder resins are polyesters, polyurethanes, epoxy resins, silicone resins, polyamides, modified rosin, and paraffin waxes. Preferred of these binder resins are styrene-alkyl (meth)acrylate copolymers and polyester resins.

Where necessary, the binder resin for making toner particles may be a crystalline resin. Any crystalline resins including crystalline polyester resins and crystalline vinyl resins may be used. Crystalline polyester resins are preferred in terms of adhesion to paper when fused, chargeability, and ease of adjusting the melting temperature within a preferred range. Aliphatic crystalline polyester resins having suitable melting temperatures are particularly preferred.

Examples of the crystalline vinyl resins are those obtained from (meth)acrylic acid esters with long-chain alkyl or alkenyl groups, such as amyl (meth)acrylate, hexyl (meth)acrylate, heptyl (meth)acrylate, octyl (meth)acrylate, nonyl (meth)acrylate, decyl (meth)acrylate, undecyl (meth)acrylate, tridecyl (meth)acrylate, myristyl (meth)acrylate, cetyl (meth)acrylate, stearyl (meth)acrylate, oleyl (meth)acrylate, and behenyl (meth)acrylate.

The crystalline polyester resins are synthesized from an acid (preferably dicarboxylic acid) component and an alcohol (preferably diol) component. In what follows, the term "acid-derived component" denotes the moiety in a polyester resin that has been an acid component before the synthesis of the polyester resin. Likewise, the term "alcohol-derived component" denotes the moiety in a polyester resin that has been an alcohol component before the synthesis of the polyester resin. As used herein, the term "crystalline polyester resin" is defined to be a polyester resin that does not exhibit a stepwise change in endothermic heat quantity but a clear endothermic peak in differential scanning calorimetry (DSC). Specifically, in DSC performed at a rate of temperature rise of 10° C./min, the endothermic peak has a half width value of 15° or less. Copolyesters composed of a crystalline polyester main chain and not more than 50% by weight of other comonomer component are also included under the term "crystalline polyester".

<Acid-Derived Component>

The acid-derived component is preferably an aliphatic dicarboxylic acid, especially a linear dicarboxylic acid. Examples thereof include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; and their lower alkyl esters and acid anhydrides. Preferred of them are those having 6 to 10 carbon atoms in terms of crystal melting temperature and chargeability. As used herein, the term "lower alkyl" is intended to mean a straight-chain, branched, or cyclic alkyl group having 1 to 8 carbon atoms. To obtain high crystallinity, it is preferred to use the linear dicarboxylic acid in a proportion of 95 mol % or more, more preferably 98 mol % or more, based on the total acid component.

Other acid-derived components that can be used in the invention is not particularly limited and include known dicarboxylic acids. Examples of such monomer components include dibasic acids, such as phthalic acid, isophthalic acid, terephthalic acid, naphthalene-2,6-dicarboxylic acid, naphthalene-2,7-dicarboxylic acid, cyclohexanedicarboxylic acid, and anhydrides and lower alkyl esters of these dibasic acids. They may be used either individually or as a combination of two or more thereof.

The acid-derived component preferably contains a dicarboxylic acid component having a sulfonic acid group, and the like in addition to the aliphatic dicarboxylic acid component. The dicarboxylic acid component with a sulfonic acid group is effective in facilitating dispersing a coloring agent, such as a pigment. In some cases where toner particles are formed by emulsifying or suspending the whole resin in water, the presence of a sulfonic acid group makes it feasible to accomplish the emulsifying or suspending without the aid of a surfactant as explained infra. Examples of such a dicarboxylic acid component include, but are not limited to, sodium 2-sulfoterephthalate, sodium 5-sulfoisophthalate, and sodium sulfosuccinate; and their lower alkyl esters and acid anhydrides. Sodium 5-sulfoisophthalate is preferred of them for the consideration of cost. The dicarboxylic acid having a sulfonic acid group is preferably used in an amount of 0.1 to 2.0 mol %, more preferably 0.2 to 1.0 mol %. At 2.0 mol % or less, good chargeability is obtained. The unit "constituent mol %" as used herein is a percentage taking each constituent (acid-derived component or alcohol-derived component) composing a polyester resin as one unit (1 mole).

<Alcohol-Derived Component>

The alcohol-derived component is preferably an aliphatic diol. Examples of suitable aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Preferred of them are those having 6 to 10 carbon atoms in view of crystal melting temperature and chargeability. To obtain high crystallinity, it is preferred to use such a linear diol in a proportion of 95 mol % or more, more preferably 98 mol % or more, based on the total diol component.

Other useful diols include bisphenol A, hydrogenated bisphenol A, bisphenol A ethylene oxide and/or propylene oxide adducts, 1,4-cyclohexanediol, 1,4-cyclohexanedimethanol, diethylene glycol, propylene glycol, dipropylene glycol, 1,3-butanediol, and neopentyl glycol. They may be used either individually or as a combination of two or more thereof.

Where necessary, other components may be used for the adjustment of acid value or hydroxyl value, including monobasic acids, such as acetic acid and benzoic acid, monohydric alcohol, such as cyclohexanol and benzyl alcohol, benzenetricarboxylic acid, and naphthalenetricarboxylic acid, anhydrides or lower alkyl esters of these polycarboxylic acids, and trihydric alcohols, such as glycerol, trimethylolethane, trimethylolpropane, and pentaerythritol.

The above described polyester resin can be synthesized from a combination of monomers appropriately chosen from the above described components by conventional methods, such as a direct polycondensation process or an ester interchange process or a combination thereof can be used. The molar ratio of the acid component to the alcohol component shall not be indiscriminately discussed, as varying depending on the reaction condition and so on. In general, however, it is usually about 1/1 in the case of a direct polycondensation process. In the case of an ester interchange process, a monomer that is easily removed by evaporation in vacuo, such as ethylene glycol, neopentyl glycol, or cyclohexanedimethanol, is often used in excess. The polymerization reaction is usually carried out at 180° to 250° C. while, if necessary, removing water or alcohol resulting from the condensation reaction under reduced pressure. When monomers do no dissolve in one another at the reaction temperature, a high boiling solvent may be added as a dissolving assistant. The polycondensation reaction is performed while removing the high boiling solvent by evaporation. When a poorly compatible monomer is present in a copolymerization system, it is advisable that the poorly compatible monomer is previously condensed with the acid component or the alcohol compound (to be polycondensed) and the resulting condensation product is subjected to polycondensation together with the main component.

Examples of catalysts that can be used in the preparation of the polyester resins include compounds of an alkali metal (e.g., sodium or lithium), compounds of an alkaline earth metal (e.g., magnesium or calcium), compounds of other metals (e.g., zinc, manganese, antimony, titanium, tin, zirconium, and germanium), phosphorous acid compounds, phosphoric acid compounds, and amine compounds. Specific examples of useful catalysts are sodium acetate, sodium carbonate, lithium acetate, lithium carbonate, calcium acetate, calcium stearate, manganese acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconium carbonate, zirconium acetate, zirconium stearate, zirconium octylate, germanium oxide, triphenyl phosphite, tris(2,4-di-t-butylphenyl)phosphite, ethyl triphenylphosphonium bromide, triethylamine, and triphenylamine. Preferred among them are tin compounds and titanium compounds in terms of chargeability of the resulting polyester. Dibutyltin oxide is particularly preferred.

The crystalline polyester resin preferably has a melting temperature of 50° to 120° C., more preferably 60° to 100° C. The crystalline resin having a melting temperature of 50° C. or higher provides a toner with improved storage stability and a fused toner image with improved storage stability. The crystalline polyester resin with a melting temperature of 120° C. or lower provides a toner with improved low-temperature fixability. In the invention, the melting temperature of the crystalline polyester resin is determined by reading the fusion peak temperature in power compensation differential scanning calorimetry specified in JIS K7121. The sample is heated from room temperature up to 150° C. at a rate of 10° C./min. Some crystalline resins show a plurality of fusion peaks, in which cases the maximum peak temperature is taken as a melting temperature.

Examples of the coloring agent used to make a toner include magnetic powders, such as magnetite and ferrite; pigments, such as carbon black, lamp black, Chromium Yellow, Hanza Yellow, Benzidine Yellow, Threne Yellow, Quinoline Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Rose Bengal, Aniline Blue, Ultramarine Blue, Calco Oil Blue, Methylene Blue chloride, Phthalocyanine Blue, Phthalocyanine Green, and Malachite Green oxalate, C.I. Pigment Red 48:1, C.I. Pigment Red 122, C.I. Pigment 57:1, C.I. Pigment Yellow 97, C.I. Pigment Yellow 17, C.I. Pigment Blue 15:1, and C.I. Pigment Blue 15:3; and dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes. These coloring agents may be used either individually or as a combination of two or more thereof.

The coloring agent content in the toner is preferably 1 to 30 parts by weight per 100 parts by weight of the binder resin. If desired, a surface-treated coloring agent may be used, and a dispersant for pigment may be used. The toner of the invention may be formulated to be a yellow toner, a magenta toner, a cyan toner, a black toner, etc. by appropriate selection of the coloring agents.

If desired, the toner of the invention may contain a release agent and a charge controlling agent. Examples of useful release agents include low molecular weight polyolefins, such as polyethylene, polypropylene, and polybutene; silicones showing a softening temperature when heated; fatty acid amides, such as oleamide, erucamide, ricinolamide, and stearamide; ester waxes; vegetable waxes, such as carnauba wax, rice wax, candelilla wax, Japan wax, and jojoba oil; animal waxes, such as bees wax; mineral or petroleum waxes, such as montan wax, ozokerite, ceresin, paraffin wax, microcrystalline wax, and Fischer-Tropsch wax; and their modified products. The release agent is preferably added in an amount of not more than 50% by weight based on the total weight of the toner.

Any known charge controlling agents may be used, such as azo metal complex compounds, salicylic acid metal complex compounds, and polar group-containing resin type charge controlling agents.

When a toner is produced in a wet process, it is preferred to use materials least soluble in water in terms of ionic intensity control and reduction of waste water pollution.

The toner of the invention may be either a magnetic toner containing a magnetic material or a nonmagnetic toner containing no magnetic material.

The toner particles for use in the invention are not limited by the method of preparation, and any known method for the preparation of toner particles may be used.

For example, the toner particles may be produced by a kneading/grinding method in which a binder resin, a coloring agent, and necessary additives such as a release agent and a charge controlling agent are blended, kneaded, ground, and classified, a method in which the particles obtained by the kneading/grinding method are subjected to mechanical shock or thermal energy to change the particle shape, an emulsification polymerization/aggregation method in which a monomer of a binder resin is emulsion polymerized, and the resulting dispersion is mixed with dispersions of a coloring agent and necessary additives, such as a release agent and a charge controlling agent to cause the dispersed particles to aggregate, heating the aggregated particles to fuse together into toner particles, a suspension polymerization method in which a monomer providing a binder resin is suspended in an aqueous solution together with a coloring agent and a solution of necessary additives, such as a release agent and a charge controlling agent, and polymerized, and a dissolution suspension method in which a binder resin, a coloring agent, and a solution of necessary additives, such as release agent and a charge controlling agent, are suspended in an aqueous solvent, followed by granulation. Aggregated particles may further be attached to the toner particles thus prepared and fused to make toner particles having a core/shell structure.

The toner particles thus obtained preferably have a volume average particle size of from about 2 μm to about 8 μm, more preferably from about 3 μm to about 7 μm. With a volume average particle size of about 2 μm or greater, the toner has good flowability and is sufficiently charged by the carrier and is therefore less likely to cause background fog and reduction in density reproducibility. With a volume average particle size of about 8 μm or smaller, good effects on fine dot reproducibility, tone reproducibility, and granularity are obtained to provide high quality images.

The toner having the recited volume average particle size is expected to achieve high fidelity of fine dot latent images even in repeatedly copying of an original having a large image area and a density gradation, such as a photograph, a picture, or a pamphlet.

$$SF1 = \frac{(ML)^2}{A} \times \frac{\pi}{4} \times 100$$

where ML is the maximum length of a particle; and A is a projected area of the particle.

The toner particles for use in the invention preferably have a shape factor SF1 of less than about 145, more preferably from about 115 to about 140, even more preferably from about 120 to about 140, on average. Toner particles having an average shape factor of less than 140 exhibit good transfer efficiency to provide high image quality. The average shape factor is an arithmetic average of the shape factor SF1 values of 1000 toner particles (enlarged 250 times) determined by scanning an optical micrograph of a toner into an image analyzer (Luzex III, produced by Nireco Corp.) and calculating an SF1 value for every particle from its maximum length and projected area.

<External Additives>

The external additives that can be used in the toner of the invention are not particularly limited. It is preferred, however, that the toner contain as an external additive small diameter particles of an inorganic oxide having a primary particle size of 7 to 40 nm and serving for such a function like powder flow improvement or charge control. Examples of the inorganic oxide useful for that purpose include silica, alumina, titanium oxides (e.g., titanium oxide and metatitanic acid), calcium carbonate, magnesium carbonate, calcium phosphate, and carbon black. Preferred of them are silica particles and titanium oxide particles. Using titanium oxide particles with a volume average particle size of from about 15 nm to about 40 nm is particularly preferred to impart good chargeability, environmental stability, flowability, caking resistance, stable negative chargeability, and stable image quality retention without influencing transparency.

It is preferred for the external additive to have its surface previously hydrophobilized. A hydrophobilized external additive exhibits improved dispersibility and is more effective in improving toner flowability, reducing environment dependence of toner chargeability, and reducing contamination of the carrier. For example, the above described small diameter inorganic oxide particles which are hydrophobilized exhibit improved dispersibility and produce an ensured effect in reducing carrier contamination. Examples of surface treating agents preferably used for the hydrophobilization treatment include dimethyldimethoxysilane, hexamethyldisilazane (HMDS), methyltrimethoxysilane, isobutyltrimethoxysilane, and decyltrimethoxysilane.

To reduce the attraction force or for charge control, it is preferred to use large diameter inorganic oxide particles with a volume average particle size of 20 to 300 nm in combination with the small diameter inorganic oxide. Examples of the inorganic oxide to be used for that purpose include silica, titanium oxide, metatitanic acid, aluminum oxide, magnesium oxide, alumina, barium titanate, magnesium titanate, calcium titanate, strontium titanate, zinc oxide, chromium oxide, antimony trioxide, magnesium oxide, and zirconium oxide. Preferred of them are silica, titanium oxide, and metatitanic acid in view of precise charge control of a toner containing lubricant particles or cerium oxide.

Where high transfer efficiency is demanded as in forming a full color image, it is preferred for the silica as the large diameter inorganic oxide to be monodisperse spherical silica having a true specific gravity of from about 1.3 to about 1.9 and a volume average particle size of from about 40 nm to about 300 nm, more preferably from about 80 nm to about 300 nm. With a true specific gravity of about 1.9 or less, the particles are prevented from coming off the toner particles. With a true specific gravity of 1.3 or more, aggregation and dispersion of the particles are prevented. The monodisperse spherical silica more preferably has a true specific gravity of 1.4 to 1.8.

The monodisperse spherical silica with an average particle size of 80 nm or greater is effective in reducing the non-electrostatic attraction force between the toner and a photoreceptor. The monodisperse spherical silica with an average particle size of 80 nm or greater is less likely to be embedded in the toner particles due to the stress in the developing unit or machine, thereby providing good developing performance and better transfer. The monodisperse spherical silica with an average particle size of 300 nm or smaller hardly come off the toner particles, which is effective in reducing the non-electrostatic attraction force. Moreover, they are less likely to move to a contact member and therefore prevented from causing secondary disorders, such as charging hindrance or image defects. The monodisperse spherical silica more preferably has an average particle size of 100 to 200 nm.

The reasons for the preference of silica as an external additive include the refractive index silica of about 1.5. That is, an increase in particle size would not result in reduction of transparency due to light scatter, particularly projection efficiency (light transmission) of a fused toner image formed on an OHP transparency.

The small diameter inorganic oxide is preferably added in an amount of 0.5 to 2.0 parts by weight per 100 parts by weight of the toner particles. The large diameter inorganic oxide is preferably added in an amount of 1.0 to 5.0 parts by weight per 100 parts by weight of the toner particles.

Lubricant particles may also be used as an external additive. Examples of useful lubricants include solid lubricants, such as graphite, molybdenum disulfide, talc, fatty acids, higher alcohols, aliphatic alcohols, and fatty acid metal salts; low molecular weight polyolefins, such as polyethylene, polypropylene, and polybutene; silicones showing a softening temperature when heated; fatty acid amides, such as oleamide, erucamide, ricinolamide, and stearamide; vegetable waxes, such as carnauba wax, rice wax, candelilla wax, Japan wax, and jojoba oil; animal waxes, such as bees wax; mineral or petroleum waxes, such as montan wax, ozokerite, ceresin, paraffin wax, microcrystalline wax, and Fischer-Tropsch wax; and their modified products. The lubricant particles preferably have a shape factor SF1 of 140 or more to provide good cleanability.

An abrasive may also be used as an external additive. Known inorganic oxides may be used as an abrasive. Examples of useful abrasives are cerium oxide, strontium titanate, magnesium oxide, alumina, silicon carbide, zinc oxide, silica, titanium oxide, boron nitride, calcium pyrophosphate, zirconia, barium titanate, calcium titanate, and calcium carbonate. Composites of these materials may be used.

The toner particles are preferably nearly spherical in view of obtaining both transfer efficiency and cleanability. The above described inorganic oxide is more effective when added to nearly spherical toner particles than to irregular toner particles. That is, with the amount added being equal, addition of the inorganic oxide to nearly spherical toner particles provides a highly flowable toner compared with addition to irregular toner particles. As a result, with the amount of charges of the charged toner being equal, a toner containing nearly spherical toner particles exhibits higher developing and transfer properties.

The toner is obtained by blending the toner particles with the additives described in a Henschel mixer, a twin-cylinder mixer, or a like device. In the cases where the toner particles are prepared in a wet process, external addition of the external additives may also be carried out in a wet system.

(Image Forming Method)

The image forming method according to the invention preferably includes the steps of forming an electrostatic latent image on the surface of an image holding member, developing the latent image with a developer containing a toner to form a toner image on the image holding member, transferring the toner image from the image holding member to a transfer receiving material, and fixing the toner image on the transfer receiving material, wherein the developer is the electrostatic image developer according to the invention. The method may further include the step of cleaning the toner remaining on the latent image holding member.

In the latent image formation step, the surface of an image holding member is evenly charged with a charging unit (a charger) and then imagewise exposed using, for example, a laser optical system or an LED array to form an electrostatic latent image. Chargers include non-contact type chargers, such as a corotron and a scorotron, and contact type chargers that apply voltage to a conductive member in contact with the surface of an image holding member thereby to charge the surface of the image holding member. Either of these types of chargers may be used. In view of controlled ozone generation, environmental friendliness, and printing life, a contact type charger is preferred. The conductive member of the contact type charger may have any form, such as a brush, a blade, a pin electrode, or a roller. A roller form is preferred. The image forming method of the invention is not limited with regard to the latent image formation step.

In the development step, a developer holding member having a developer layer containing the toner formed on its surface is brought into contact with or close to the image holding member thereby to attract toner particles onto the latent image on the image holding member. A toner image is thus formed on the surface of the image holding member. A known development system is used. Examples of development systems using a two-component developer used in the present invention include cascade development and magnetic brush development. The image forming method of the invention is not limited with respect to the development system.

In the transfer step, the toner image on the image holding member is transferred either directly or indirectly to a transfer receiving material (or a recording medium). In the latter case, the toner image on the image holding member is once transferred to an intermediate transfer receiving material and then to a transfer member.

The transfer unit that can be used to transfer the toner image from the image holding member to, for example, paper, is exemplified by a corotron. However, a corotron, though effective as a means for evenly charging paper, needs high voltage as high as several kilovolts to give paper a prescribed charge quantity and therefore requires a high voltage power source. In addition to this, a corona discharge is accompanied by ozone generation, which induces deterioration of rubber parts and the image holding member. Therefore, a contact transfer system is preferred, in which an electrically conductive transfer roller having an elastic material is pressed toward the image holding member thereby to transfer the toner image to paper. The image forming method of the invention is not limited with respect to the transfer unit.

In the fixing step, the toner image transferred to the transfer receiving material is fixed by a fixing unit. The fixing step is preferably carried out using a heat fixing unit having a heat roller. The heat fixing unit is composed of a fixing roller and a pressure roller or belt. The fixing roller has a metal cylinder, a heater lamp inside the cylinder, and a release layer of a heat resistant resin or rubber around the cylinder. The pressure roller or belt is a metal cylinder or belt having a heat resistant elastic material layer therearound or thereon and is pressed to the fixing roller. The transfer receiving material (recording medium) having a toner image is passed between the fixing roller and the pressure roller or belt, whereby the binder resin, the additive, and the like in the toner are fused to fix the toner image. The image forming method of the invention is not limited with respect to the fixing system.

In the cleaning step, the toner, paper dust, or any other debris remaining on the surface of the image holding member are removed by bringing a cleaning member, such as a blade, a brush, or a roller, directly to the image holding member.

The most commonly used cleaning system is a blade cleaning system using a blade made of rubber, e.g., polyurethane, pressed onto the image holding member. The cleaning may also be carried out by a magnetic brush cleaning system using a magnetic brush having a rotating nonmagnetic cylindrical sleeve and magnets stationary arranged inside the sleeve and having a magnetic carrier held on the peripheral surface of the sleeve to collect the residual toner or a cleaning system in which a roller having semi-conductive resin fiber or animal hair on its surface is used, to which a bias of opposite polarity opposite to the toner is applied to remove the residual toner. In the magnetic brush cleaning system, a corotron may be used to give a pretreatment before cleaning. The cleaning system employed in the image forming method of the invention is the blade cleaning system.

A full color image is preferably formed as follows. A plurality of latent images of different colors are formed on the respective image holding members, developed by the respective developer holding members, successively transferred to the same transfer receiving material to make a full color toner image, which is then thermally fixed in the fixing step. Use of the electrophotographic developer according to the invention in the above described image forming method provides stability of development, transfer, and fixing performance even in, for example, a tandem electrophotographic system suited to achieve printer size reduction and high speed color printing.

Examples of the transfer receiving material (recording material) onto which a toner image is transferred include plain paper and OHP transparencies that are used in electrophotographic copiers or printers. To obtain a fixed image with improved surface smoothness, it is desirable for the transfer receiving material to have as smooth a surface as possible. In this regard, coated paper (plain paper coated with a resin, etc.) and art paper for printing are preferably used.

(Image Forming Apparatus)

The image forming apparatus according to the invention preferably includes an image holding member, a charging unit for charging the image holding member, an exposing unit for imagewise exposing the charged image holding member to form an electrostatic latent image on the surface of the image holding member, a developing unit for developing the latent image with a developer containing a toner to form a toner image, a transfer unit for transferring the toner image from the image holding member to a transfer receiving material, and a fixing unit for fixing the transferred toner image on the transfer receiving material, wherein the electrostatic image developer of the invention is used as the developer.

The transfer unit may be designed to conduct two or more transfer operations using an intermediate transfer member.

The image holding member and the units of the image forming apparatus preferably have the respective structures described with respect to the respective steps of the above described image forming method of the invention.

Known units of conventional image forming apparatus are employable as the units of the image forming apparatus according to the invention. The apparatus of the invention may further include members and units other than those described. The apparatus of the invention may be configured to perform functions of two or more of the units described at a time.

(Process Cartridge)

The process cartridge according to an aspect of the invention preferably includes a developing unit that stores the electrostatic image developer of the invention and develops an electrostatic latent image formed on the surface of an image holding member with the developer to form a toner image; and at least one member selected form the group consisting of the image holding member, a charging unit that charges the surface of the image holding member, and a cleaning unit that removes a residual toner remaining on the surface of the image holding member.

The process cartridge is preferably configured to be removably mounted to an image forming apparatus. If desired, the process cartridge may further include other members or units, such as a discharging unit. The process cartridge may have a known configuration.

EXAMPLES

The invention will now be illustrated in greater detail with reference to Examples. Unless otherwise noted, all the parts are by weight.

Methods of measuring physical properties of carriers, etc. in Examples and Comparative Examples are described below.

(1) Mg Content of Ferrite Particles

The Mg content of ferrite particles as a carrier is determined by X-Ray fluorescence analysis. A sample of X-ray fluorescence analysis is made by pressing ferrite particles to be analyzed in a compressor under a pressure of 10 t for 1 minute. Analysis is carried out using X-ray fluorescence analyzer (XRF-1500 from Shimadzu Corp.) under conditions of a tube voltage of 49 kV, a tube current of 90 mA, and a measuring time of 30 minutes. The magnesium content of the sample is calculated from a calibration curve previously prepared using a few samples with known magnesium contents.

(2) Average Distribution Ratio D in Ferrite Particles

Carrier particles are embedded in an epoxy resin, and the resulting block is sliced with a diamond knife until a cross-section of the carrier appears sufficiently. The elemental iron content Fe and elemental magnesium content Mg of the entire cross-section are determined using an energy dispersive X-ray analyzer (EMAX, from Horiba, Ltd.) to obtain an Mg to Fe weight ratio W1. Then, an Mg to Fe weight ratio W2 in a square the opposite vertices of which are located at two points on a diameter of a circle circumscribing the cross-section, each being half the radius distant from the center of the circumscribing circle, is determined. A ratio of W1 to W2, W1/W2, is calculated to give an elemental magnesium distribution ratio D'. The same measurements are made on at least 50 ferrite particles to obtain an average distribution ratio D.

(3) Melting Temperature and Glass Transition Temperature

The melting temperature and glass transition temperature of are measured using a differential scanning calorimeter DSC-20 from Seiko Instruments Inc. In the measurement, a sample weighing 10 mg is heated at a rate of 10° C./min.

The melting temperature of a crystalline resin is obtained by reading the fusion peak temperature in a power compensation differential scanning calorimetry specified in JIS K7121:87. The sample is heated from room temperature up to 150° C. at a rate of 10° C./min. Some crystalline resins show a plurality of fusion peaks, in which cases the maximum peak temperature is taken as a melting temperature.

The glass transition temperature of an amorphous resin is measured according to ASTM D3418-82.

(4) Weight Average Molecular Weight Mw and Number Average Molecular Weight Mn

Molecular weight distribution of a toner is determined by gel permeation chromatography using a gel permeation chromatograph HLC-8120GPC and a data processor SC-8010, both form Tosoh Corp., equipped with two columns TSKgel Super HM-H from Tosoh Corp. (6.0 mm ID×15 cm) and an IR detector. Tetrahydrofuran is used as an eluent. The measuring conditions are: a sample concentration of 0.5%, a flow rate of 0.6 ml/min, an injection size of 10 μl, and a system temperature of 40° C. A calibration curve is prepared using ten polystyrene standards TSK A-500, F-1, F-10, F-80, F-380, A-2500, F-4, F-40, F-128, and F-700, all from Tosoh Corp.

(5) Average Particle Size

Volume average particle size is measured with Coulter Multisizer II from Beckman Coulter Inc. using an aperture of 50 μm. Unless otherwise specified, the measured particle sizes are volume average particle sizes. A sample dispersion to be analyzed is prepared by putting particles weighing 1.0 mg in 2 ml of a 5 wt % aqueous solution of a surfactant (preferably a sodium alkylbenzenesulfonate) as a dispersant, adding the mixture to 100 ml of an electrolyte solution, and dispersing the electrolyte solution having the particles suspended in an ultrasonic disperser for 1 minute. An aperture diameter of 50 μm is chosen to determine volume average and number average particle size distributions between 1 μM and 30 μm. The number of particles to be analyzed is 50,000.

Particles smaller than about 5 μm are analyzed with a laser diffraction scatter particle size analyzer LA-700, from Horiba, Ltd. Even smaller particles sized on the order of nanometers are analyzed using a BET specific surface analyzer Flow Sorb II 2300 from Shimadzu Corp.

Preparation of Core 1 (Ferrite Particles 1)

One thousand parts of $Fe_2O_3$, 100 parts of $Mg(OH)_2$, and 20 parts of $CaCO_3$ are blended and ground in a wet ball mill and granulated using a spray dryer over 25 hours. After drying, the particles are provisionally calcined in a rotary kiln at 900° C. for 7 hours (1st provisional calcination). The provisionally calcined product is ground in a wet ball mill for 2 hours to have an average particle size of 2.0 μm, again granulated using a spray dryer, dried, and provisionally calcined at 1000° C. for 6 hours (2nd provisional calcination). The product of the 2nd provisional calcination is ground in a wet ball mill for 5 hours to have an average particle size of 5.6 μm, granulated using a spray dryer, dried, and mainly calcined in an electric furnace first at 1300° C. for 5 hours and then additionally calcined at 1150° C. for 4 hours. The product after the additional calcination is disintegrated and classified to obtain Mg ferrite particles 1 with an average particle size of 35 μm.

Preparation of Cores 2 to 11 (Ferrite Particles 2 to 11)

Cores 2 to 11 with an average particle size of 35 μm are prepared in the same manner as for core 1, except for changing the composition and preparation conditions as shown in Tables 1 and 2 below.

TABLE 1

| | $Fe_2O_3$ | $Mg(OH)_2$ | $CaCO_3$ | $SrCO_3$ | MnO |
|---|---|---|---|---|---|
| Core 1 | 1000 | 100 | 20 | — | — |
| Core 2 | 1000 | 100 | 20 | — | — |
| Core 3 | 1000 | 100 | 20 | — | — |
| Core 4 | 1000 | 200 | 3 | — | — |
| Core 5 | 1000 | 300 | 4 | — | — |
| Core 6 | 1000 | 100 | — | 2 | — |
| Core 7 | 1000 | 40 | 3 | — | — |
| Core 8 | 1000 | 40 | 3 | — | — |
| Core 9 | 1000 | 7 | 3 | — | — |
| Core 10 | 1000 | 450 | 5 | — | — |
| Core 11 | 1000 | — | — | 5 | 160 |

TABLE 2

| Step | 1st Provisional Calcination | | 2nd Provisional Calcination | | Grinding Product of 2nd Provisional Calcination | | Main Calcination | | Additional Calcination | |
|---|---|---|---|---|---|---|---|---|---|---|
| Core 1 | 900° C. | 7 hrs | 1000° C. | 6 hrs | 5 hrs | 5.6 μm | 1300° C. | 5 hrs | 1150° C. | 4 hrs |
| Core 2 | 900° C. | 7 hrs | 1000° C. | 6 hrs | 6 hrs | 5 μm | 1300° C. | 5 hrs | 1150° C. | 2 hrs |
| Core 3 | 900° C. | 7 hrs | 1000° C. | 8 hrs | 5 hrs | 5.6 μm | 1350° C. | 4.5 hrs | 1150° C. | 5 hrs |
| Core 4 | 900° C. | 7 hrs | 1000° C. | 6 hrs | 5 hrs | 5.6 μm | 1280° C. | 4 hrs | 1150° C. | 4 hrs |
| Core 5 | 900° C. | 7 hrs | 1000° C. | 4 hrs | 4 hrs | 6 μm | 1200° C. | 4 hrs | 1150° C. | 2 hrs |
| Core 6 | 900° C. | 7 hrs | 1000° C. | 6 hrs | 5 hrs | 5.6 μm | 1300° C. | 5 hrs | 1150° C. | 4 hrs |
| Core 7 | 1000° C. | 7 hrs | — | — | 4 hrs | 6 μm | 1250° C. | 5 hrs | — | — |
| Core 8 | 900° C. | 7 hrs | 950° C. | 9 hrs | 6 hrs | 5 μm | 1000° C. | 8 hrs | 1100° C. | 48 hrs |
| Core 9 | 900° C. | 7 hrs | 1000° C. | 6 hrs | 5 hrs | 5.6 μm | 1250° C. | 6 hrs | 1150° C. | 4 hrs |
| Core 10 | 900° C. | 7 hrs | — | — | 5 hrs | 5.6 μm | 1200° C. | 4 hrs | 1150° C. | 2 hrs |
| Core 11 | 900° C. | 8 hrs | — | — | 6 hrs | 5.7 μm | 1300° C. | 5 hrs | — | — |

Preparation of Coating Composition 1

| | |
|---|---|
| Styrene-acrylic acid-methyl methacrylate copolymer (84.5:0.5:15 by mole; Mw = 40,000) | 36 parts |
| Carbon black VXC72 (from Cabot Corp.) | 4 parts |
| Toluene | 250 parts |
| Isopropyl alcohol | 50 parts |

The above components are put in a sand mill (from Kansai Paint Co., Ltd.) together with glass beads (particle size: 1 mm; in an amount equal to toluene) and stirred at 1200 rpm for 30 minutes to prepare coating composition 1 having a solids content of 11%.

Preparation of Coating Composition 2

| | |
|---|---|
| Styrene-acrylic acid-methyl methacrylate copolymer (84.5:0.5:15 by mole; Mw = 40,000) | 36 parts |
| Magnesium oxide (volume average particle size: 0.7 μm) | 8 parts |
| Toluene | 300 parts |
| Isopropyl alcohol | 50 parts |

The above components are put in a sand mill (from Kansai Paint Co., Ltd.) together with glass beads (particle size: 1 mm; in an amount equal to toluene) and stirred at 1200 rpm for 30 minutes to prepare coating composition 2 having a solids content of 11%.

Preparation of Carriers 1 to 11

A vacuum degassing kneader is charged with 2000 parts of core 1 and 380 parts of coating composition 1 and evacuated while stirring to −200 mmHg relative to atmospheric pressure at 60° C., and the mixture is kneaded for 20 minutes. The temperature is raised to 90° C., and the pressure is reduced to −720 mmHg relative to atmospheric pressure, and the stirring is continued for 30 minutes to dry the particles to obtain resin-coated carrier particles. The particles are passed through a 75 μm mesh sieve to obtain carrier 1.

Carriers 2 to 11 are obtained in the same manner as for carrier 1, except for changing the core/resin combination as shown in Table 3, in which "compsn." is an abbreviation of "composition".

The Mg content (wt %) of the core of each of carriers 1 to 11 and the Mg distribution ratio D in a cross-section of carrier particles are shown in Table 4.

TABLE 3

| | Core (part) | | Coating Composition (part) | | Coating Weight (wt %) |
|---|---|---|---|---|---|
| Carrier 1 | core 1 | 2000 | compsn. 1 | 380 | 2 |
| Carrier 2 | core 2 | 2000 | compsn. 2 | 380 | 2 |
| Carrier 3 | core 3 | 2000 | compsn. 1 | 380 | 2 |
| Carrier 4 | core 4 | 2000 | compsn. 1 | 380 | 2 |
| Carrier 5 | core 5 | 2000 | compsn. 1 | 380 | 2 |
| Carrier 6 | core 6 | 2000 | compsn. 1 | 380 | 2 |
| Carrier 7 | core 11 | 2000 | compsn. 2 | 380 | 2 |
| Carrier 8 | core 7 | 2000 | compsn. 1 | 380 | 2 |
| Carrier 9 | core 8 | 2000 | compsn. 1 | 380 | 2 |
| Carrier 10 | core 9 | 2000 | compsn. 1 | 380 | 2 |
| Carrier 11 | core 10 | 2000 | compsn. 1 | 380 | 2 |

TABLE 4

| | Core | Mg Content (wt %) | Distribution Ratio D |
|---|---|---|---|
| Carrier 1 | core 1 | 4 | 1.5 |
| Carrier 2 | core 2 | 4 | 1.1 |
| Carrier 3 | core 3 | 4 | 1.8 |
| Carrier 4 | core 4 | 8 | 1.5 |
| Carrier 5 | core 5 | 13 | 1.5 |
| Carrier 6 | core 6 | 4 | 1.4 |
| Carrier 7 | core 11 | 0 | — |
| Carrier 8 | core 7 | 8 | 0.9 |
| Carrier 9 | core 8 | 8 | 2.2 |
| Carrier 10 | core 9 | 0.4 | 1.5 |
| Carrier 11 | core 10 | 18 | 1.2 |

Preparation of Pigment Dispersion 1

| | |
|---|---|
| Cyan pigment: copper phthalocyanine (C.I. Pigment Blue 15:3), from Dainichiseika Color & Chemicals Mfg. Co., Ltd. | 50 parts |
| Anionic surfactant: Neogen, from Dai-ichi Kogyo Seiyaku Co., Ltd. | 5 parts |
| Ion exchanged water | 200 parts |

The above components are mixed and dispersed in a homogenizer Ultra Turrax from IKA GmBH for 5 minutes and then in an ultrasonic bath for 10 minutes to prepare pigment dispersion 1 having a solid content of 21%. The dispersed particles are found to have a volume average particle size of 160 nm as measured with a particle size analyzer LA-700 from Horiba, Ltd.

Preparation of Release Agent Dispersion 1

| | |
|---|---|
| Paraffin wax: HNP-9 from Nippon Seiro Co., Ltd. | 19 parts |
| Anionic surfactant: Neogen SC from Dai-ichi Kogyo Seiyaku | 1 part |
| Ion exchanged water | 80 parts |

The above components are mixed in a heat resistant container. The inner temperature is raised to 90° C., at which the mixture is stirred for 30 minutes. The resulting melt is circulated from the bottom of the container to a Gaulin homogenizer and homogenized under a pressure of 5 MPa for three passes and then under a pressure of 35 Mpa for another three passes. The resulting emulsion is cooled to 40° C. or lower in the heat resistant container to obtain release agent dispersion 1. The volume average particle size was 240 nm as measured with LA-700.

Preparation of Resin Dispersion 1

| | |
|---|---|
| Oily layer: | |
| Styrene from Wako Pure Chemical Inds., Ltd. | 30 parts |
| n-Butyl acrylate from Wako Pure Chemical | 10 parts |
| β-Carboxyethyl acrylate from Rhodia Nicca | 1.3 parts |
| Dodecanethiol from Wako Pure Chemical | 0.4 parts |
| Aqueous layer 1: | |
| Ion exchanged water | 17 parts |
| Anionic surfactant: Dowfax from Dow Chemical Co. | 0.4 parts |
| Aqueous layer 2: | |
| Ion exchanged water | 40 parts |
| Anionic surfactant: Dowfax | 0.05 parts |
| Ammonium peroxodisulfate from Wako Pure Chemical | 0.4 parts |

The components of the oily layer and the components of the aqueous layer 1 are put in a flask and mixed by stirring to make a monomer dispersion. The components of the aqueous layer 2 are poured into a reaction vessel. After the vessel is thoroughly purged with nitrogen, the contents are heated in an oil bath up to 75° C. while stirring. The monomer dispersion is added dropwise into the reaction vessel over 3 hours to conduct emulsion polymerization. After completion of the dropwise addition, the polymerization was further continued for an additional 3 hour period at 75° C. The reaction is stopped to obtain resin dispersion 1.

Preparation of Toner 1

| | |
|---|---|
| Resin dispersion 1 | 150 parts |
| Pigment dispersion 1 | 30 parts |
| Release agent dispersion 1 | 40 parts |
| Poly(aluminum chloride) | 0.4 parts |

The above components are put in a stainless steel flask and thoroughly mixed using Ultra Turrax (IKA GmBH). The flask is then heated to 48° C. while stirring on an oil bath and maintained at that temperature for 80 minutes. An additional 70 parts of the same resin dispersion is gently added to the system. After the pH of the system is adjusted to 6.0 by the addition of a 0.5 mol/l aqueous solution of sodium hydroxide, the flask is closed with the stirrer shaft sealed with a magnetic seal, and the mixture is heated up to 97° C. while stirring, at which it is maintained for 3 hours. After completion of the reaction, the reaction system is cooled at a rate of 1° C./min and filtered by suction using a Buechner funnel. The collected solid is re-dispersed in 3000 parts of ion exchanged water at 40° C., followed by stirring at 300 rpm for 15 minutes. This washing operation is repeated five times, and the dispersion is finally filtered by suction using a Buechner funnel and No. 5A filter paper. The filter cake is dried in vacuo for 12 hours to give toner particles.

To the toner particles are added silica ($SiO_2$) particles having been hydrophobilized with hexamethyldisilazane and having an average primary particle size of 40 nm and metatitanic acid compound particles having an average primary particle size of 20 nm which are a reaction product between metatitanic acid and isobutyltrimethoxysilane each in such an amount as to cover 40% of the surface of the colored particles, followed by mixing in a Henschel mixer to prepare toner 1.

Examples 1 to 6 and Comparative Examples 1 to 5

Each of the carriers shown in Table 4 and toner 1 are blended in a carrier to toner weight ratio of 100:6 to make a developer. The resulting developers are evaluated as follows. The results obtained are shown in Table 5.

Developer Evaluation Method

A modified model of a multifunctional peripheral DocuCentre Color 400 (Fuji Xerox) is loaded with the developer to be evaluated. A 5 cm wide 10 cm long solid patch is printed in an environment of 10° C. and 10% RH to produce 20,000 prints. The printing job is carried out not continuously but the developing unit is stopped for every print. The density C1 of the first print and the density C2 of the 20,000th print are measured with a reflection densitometer X-Rite 404 (X-Rite Inc.).

The developing unit is once detached from DocuCentre Color 400, left to stand in an environment of 32° C. and 88% RH for 4 days, and again mounted. The same solid patch (5 cm×10 cm) is then printed to obtain 5 prints. The density C5 of the fifth print is measured.

The performance stability of the developer against stressed printing is evaluated from percentage change between densities C1 and C2 (C2/C1 change=|C1−C2|/C1×100(%)). A developer showing a C2/C1 change of less than 5% is rated "very good"; between 5% and 10%, "good"; and more than 10%, "bad".

The performance stability of the developer against environmental change is evaluated from percentage change between densities C1 and C5 (C5/C1 change=|C1−C5|/C1×100(%)). A developer showing a C5/C1 change of less than 5% is rated "very good"; between 5% and 10%, "good"; and more than 10%, "bad".

The appearance of the 20,000th print is evaluated. A print with no abnormalities is rated "very good". A print with a few streaks is rated "good". A print with streaks appearing all over the image is rated "bad".

TABLE 5

| | Carrier | Density Change due to Stressed Printing | Density Change due to Environmental Change | Appearance of Print |
|---|---|---|---|---|
| Example 1 | carrier 1 | very good | very good | very good |
| Example 2 | carrier 2 | very good | good | very good |
| Example 3 | carrier 3 | good | very good | very good |
| Example 4 | carrier 4 | good | good | good |
| Example 5 | carrier 5 | good | good | good |
| Example 6 | carrier 6 | good | good | good |
| Comparative Example 1 | carrier 8 | good | bad | bad |
| Comparative Example 2 | carrier 9 | bad | good | bad |
| Comparative Example 3 | carrier 10 | bad | bad | bad |

TABLE 5-continued

| | Carrier | Density Change due to Stressed Printing | Density Change due to Environmental Change | Appearance of Print |
|---|---|---|---|---|
| Comparative Example 4 | carrier 11 | bad | bad | bad |
| Comparative Example 5 | carrier 7 | bad | bad | good |

What is claimed is:

1. A process of producing an electrostatic image developing carrier, comprising:

provisionally calcining a carrier material comprising an iron compound and a magnesium compound at a temperature of from about 800° C. to about 1000° C.;

mainly calcining the provisionally calcined carrier material at a temperature of higher than about 1000° C. and not higher than about 1400° C.; and additionally calcining the mainly calcined carrier material at a temperature lower than the temperature of the main calcination to obtain an electrostatic image developing carrier comprising ferrite particles, wherein a content of magnesium in the ferrite particles in the electrostatic image developing carrier is from 4 wt % to 14 wt %, wherein the ferrite particles have a higher magnesium content in a surface portion than in a central portion, and wherein the ferrite particles do not include lithium.

2. The process according to claim 1, wherein the temperature of the additional calcining is from 900° C. to 1250° C.

3. The process according to claim 1, wherein the content of magnesium in the ferrite particles in the electrostatic image developing carrier is from 4 wt % to 13 wt %.

4. The process according to claim 1, wherein the content of magnesium in the ferrite particles in the electrostatic image developing carrier is from 4 wt % to 8 wt %.

* * * * *